US007669621B2

(12) United States Patent
Nettles et al.

(10) Patent No.: US 7,669,621 B2
(45) Date of Patent: Mar. 2, 2010

(54) STATIONARY BEDKNIFE FOR DISC CHIPPER APPARATUS

(75) Inventors: Timothy Paul Nettles, Carthage, NY (US); John P. Storms, Carthage, NY (US)

(73) Assignee: CEM Machine, Inc., Carthage, NY (US)

( * ) Notice: Subject to any disclaimer, the term of this patent is extended or adjusted under 35 U.S.C. 154(b) by 663 days.

(21) Appl. No.: 11/503,811

(22) Filed: Aug. 14, 2006

(65) Prior Publication Data

US 2008/0035242 A1 Feb. 14, 2008

(51) Int. Cl.
*B27C 1/00* (2006.01)

(52) U.S. Cl. ..... 144/176; 144/162; 241/92; 241/298

(58) Field of Classification Search ..... 144/162.1, 144/176, 185, 162, 373, 174; 83/72; 241/242, 241/92, 243, 286, 186.35, 189.1
See application file for complete search history.

(56) References Cited

U.S. PATENT DOCUMENTS 4,155,384 A * 5/1979 Svensson ..... 144/176
4,653,256 A 3/1987 Saiia
4,784,337 A * 11/1988 Nettles et al. ..... 241/92
4,827,989 A * 5/1989 Strong ..... 144/176
5,129,437 A 7/1992 Nettles et al.
5,139,063 A * 8/1992 Nettles et al. ..... 144/176
5,155,975 A * 10/1992 Knowler ..... 53/513
5,236,024 A * 8/1993 Svensson et al. ..... 144/176
5,323,975 A * 6/1994 Fulghum, Jr. ..... 144/176
5,348,064 A 9/1994 Nettles et al.
5,373,876 A 12/1994 Tahkanen et al.
5,655,582 A * 8/1997 Morin ..... 144/176
5,678,294 A 10/1997 Kokko
5,971,305 A * 10/1999 Davenport ..... 241/197
5,975,169 A 11/1999 Jonkka et al.
6,148,882 A * 11/2000 Nettles ..... 144/329
6,299,082 B1 * 10/2001 Smith ..... 241/186.35
6,848,486 B2 2/2005 Heikkinen
6,938,844 B2 * 9/2005 Castronovo ..... 241/30
6,976,516 B2 12/2005 Hale et al.
7,267,146 B2 * 9/2007 Olofsson ..... 144/176
7,300,009 B2 * 11/2007 Dallimore et al. ..... 241/275
7,461,802 B2 * 12/2008 Smidt et al. ..... 241/186.35
2004/0050453 A1 3/2004 Heikkinen (Continued)

FOREIGN PATENT DOCUMENTS

WO WO 01/56757 A 8/2001

*Primary Examiner*—Dana Ross
*Assistant Examiner*—Jennifer Chiang
(74) *Attorney, Agent, or Firm*—Hiscock & Barclay, LLP

(57) ABSTRACT

A disc cutting apparatus for chipping wood chips from a log includes a chipper frame, a rotary cutting disc having a plurality of substantially radially disposed knife assemblies in relation to a proximal facing side of the disc and a feed spout into which a log is fed into the chipper apparatus. The apparatus further includes a bedknife, the bedknife having a first surface and an opposing second surface that is nonparallel to the first surface such that a wedge is produced between the first surface and the second surface for fitting within a corresponding nonparallel gap in the chipper frame. The bedknife further includes at least one secondary trimming edge for more complete reduction of wood chipped and for reducing the size of slivers formed.

8 Claims, 6 Drawing Sheets

U.S. PATENT DOCUMENTS

2004/0060616 A1 4/2004 Jonkka et al.
2006/0006259 A1 1/2006 Jonkka et al.
2006/0086420 A1* 4/2006 Olofsson ..... 144/176

* cited by examiner

STATIONARY BEDKNIFE FOR DISC CHIPPER APPARATUS

FIELD OF THE INVENTION

The application relates to the field of rotary disc chipping apparatus for cutting substantially uniform chips from logs. In particular, this application is directed to an improved bedknife for use in a rotary disc chipper.

BACKGROUND OF THE INVENTION

In the pulp and paper industry, the chipping of wood is performed by means of centrifugal or rotary wood chipping apparatus, often commonly referred to as disc chippers. Disc chippers reduce logs that are introduced, either at least partially vertically under the aid of gravity or conveyed horizontally, into a feed spout or chute of the apparatus. The logs are passed in relation to a cutting disc element that is rotated about an axis, the disc element having a plurality of radial cutting surfaces (e.g., knives) that chip the logs against a fixed bedknife (also commonly referred to as an anvil or counterblade) that is fastened to the chipper frame and disposed in relation to the lower or rear portion of the feed spout.

In operation, the cutting disc element is caused to rotate about its axis by means of a drive mechanism and the logs entering the feed spout slide against the bedknife and are effectively reduced into chips that pass through openings provided in the cutting disc, as shown for example in FIG. 7.

Based on the present design of such apparatus, it is possible that a number of long thin longitudinal strips or slivers are formed from the cutting operation. The creation of slivers can drastically impede upon the throughput of the chipper, requiring undesired maintenance to remove them from the apparatus as well as additional equipment to remove the slivers and further process this objectionable product from the chips produced. To that end, efforts have been made in the prior art in order to reduce the size or incidence of slivers, such as by incorporation of sliver rings. These assemblies are useful in preventing slivers from reaching a predetermined size, but these features do not actually reduce the overall incidence of slivers. Other assemblies, such as those described in U.S. Pat. No. 5,139,063, include arcuate wrapper assemblies that are mounted to the cover of the chipper and in relation to the cutting plane. Such assemblies, however, must be separately attached to the chipper, adding to the overall complexity and cost thereof.

It should be noted that the bedknife and feed spout are each susceptible to increased amounts of wear during use and may have to be replaced or serviced at various intervals. In addition, the bedknife disc or disc knives may also require adjustment in order to preserve the critical and extremely tight clearance relationship between the cutting edge of the bedknife and that of the plane of the blades of the rotary cutting disc. The positioning of the bedknife in relation to the blades of the cutting disc is critical with regard to the overall performance of the chipper. In this regard, replacement and/or adjustment of a bedknife is an extremely labor intensive and time consuming effort, requiring significant teardown of the apparatus. To that end, a number of attempts have been made in the prior art to reduce the effort involved. For example, according to U.S. Pat. No. 6,148,882, the patentee conceived the concept of a separate element that is introduced between the chipper frame and an external surface of the bedknife. This element is caused to move into place between the bedknife and the chipper frame wherein adjustment and/or replacement of the bedknife are facilitated. However, the use of such assemblies again requires the use of separate parts and added complexity and cost for purposes of operation.

Therefore, there is a general and perceived need to provide a bedknife for a disc chipper which can be maintained adjusted and/or replaced more easily than those previously in the field. There is also a general and perceived need in the field to improve the overall efficacy of cutting operations and throughput of disc chippers, including the elimination or substantial reduction of unwanted slivers.

SUMMARY OF THE INVENTION

According to one exemplary aspect, there is provided a disc cutting apparatus for chipping wood chips from a log, said apparatus comprising a chipper frame, a rotary cutting disc including a plurality of substantially radially disposed knife assemblies in relation to a proximal facing side of said disc, a feed spout into which a log is fed into said chipper apparatus, and a bedknife. The bedknife has a first surface and an opposing second surface that is nonparallel to said first surface, such that a wedge is produced between said first surface and said second surface for fitting within a corresponding nonparallel gap in the chipper frame.

The bedknife is slightly oversized with regard to the frame pocket retaining same, wherein and according to one version, a cap is used in overlaying fashion relative to a top surface of the bedknife in order to pinch the bedknife within the defined gap in the chipper frame. Means, such as a hydraulic or other mechanical jack, can be used to unseat the bedknife and permit removal of the bedknife from the chipper frame.

At least one bedknife liner can be optionally provided, such as between the bedknife and the frame, wherein the bedknife liner can include a nonparallel spacing or taper matching that of the bedknife to facilitate pinching of the bedknife in place within the frame.

According to another aspect of the application, there is disclosed a disc chipper apparatus for chipping substantially uniform wood chips from a log, said apparatus comprising a chipper frame, a rotary cutting disc including a plurality of radially disposed cutting blades, and a bedknife including a primary cutting edge disposed in relation to said cutting disc, said bedknife further including a recessed area forming a secondary cutting edge for trimming slivers.

In one version, the recessed area is defined by machining a portion of the bedknife, thereby creating a cavity that is sized to trap the slivers passing through the cutting area of the disc chipper. The perimeter of the recessed area forms the secondary cutting edge of the bedknife, wherein any formed slivers are consequently pulled into the recessed area of the bedknife and are trimmed or cut to manageably sized pieces.

The herein described bedknife design can be used effectively in either a longitudinal or at least partially gravity fed chipping apparatus.

One advantage provided by the herein described bedknife is that slivers are effectively reduced to manageably sized material, thereby improving the overall cutting operation of a rotary disc chipper. The incorporation of an integral sliver trimmer feature in the bedknife permits added functionality, but without sacrificing overall footprint (i.e., size) of the chipper.

Another advantage is that the design of the herein described bedknife permits the bedknife to be effectively pinched within the confines of the frame, thereby facilitating removal and/or adjustment of the bedknife without having to fully disassemble larger portions of the chipper frame, the feed spout and/or other significant portions of the apparatus.

This design eliminates the need for added components to effectively hold the bedknife in place during operation, and also eliminates the need for secondary and separate bedknives to trim slivers. Also, due to the fact that the secondary trimmer edge is machined in conjunction with the primary cutting edge, these edges will always be at a predetermined location and projection, which makes adjustments between the edges unnecessary.

These and other features and advantages will become readily apparent from the following Detailed Description, which should be read in conjunction with the accompanying drawings.

DETAILED DESCRIPTION

The following relates to an exemplary embodiment of a stationary bedknife as used in a rotary wood chipping apparatus, hereinafter referred to throughout as disc chippers or chippers. It will be readily apparent that other modifications and variations are possible within the inventive ambits discussed herein. For example, the following discussion relates to the inclusion of the exemplary bedknife in a horizontal disc chipper. However, it will become immediately clear that other apparatus, e.g., gravity feed disc chippers, could similarly be utilized. Moreover, the presently described bedknife relates to a vertical bedknife (e.g., the cutting edge is disposed in a substantially vertical orientation). However, the inventive concepts described herein are not intended to be limited to this geometry. In addition, certain terms are used through the course of discussion in order to provide a frame of reference with regard to the accompanying drawings. These terms should not be regarded as overlimiting as to the recited claims, however, except where specifically indicated.

Figure 1:
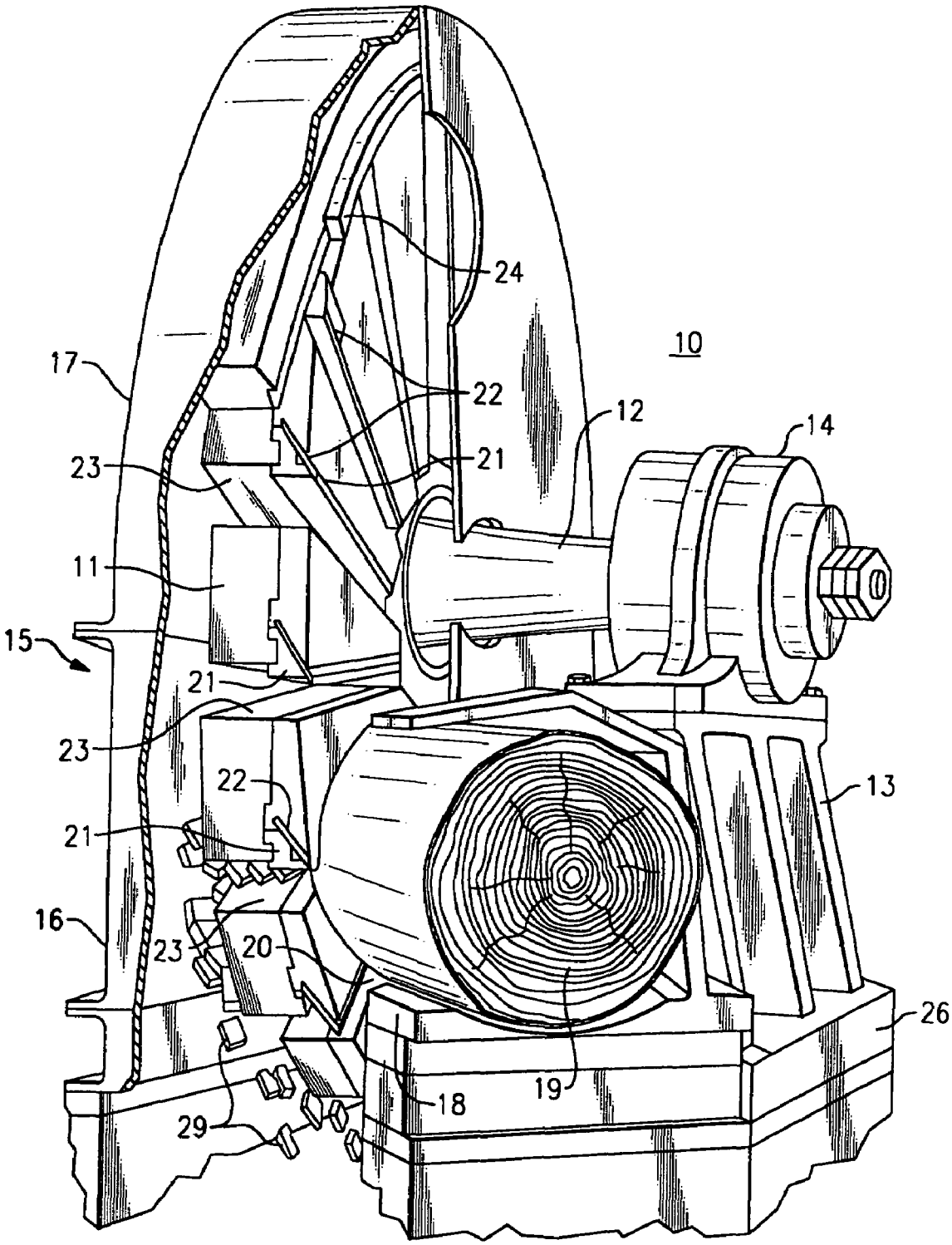
FIG.1 Prior Art
FIG. 1 is a perspective view, partially broken away, of a prior art disc chipper apparatus.

Referring to FIG. 1, there is first shown a well known disc chipper in accordance with the prior art. The chipper 10 includes a vertically disposed rotary disc 11 that is rotated upon a horizontal drive shaft 12. The shaft 12 is supported on a mount 13 in a suitable heavy-duty bearing 14. A motor (not shown) is used to rotate the disc 11, the disc being shielded by a cover 15, of which there is a lower fixed portion and a removable hood 17 covering an upper portion of the disc. The illustrated chipper 10 is of the shaft over spout design, having a feed spout or chute 18 that is disposed at an angle below the horizontal drive shaft 12. A log 19 or stick is shown in this view as advancing through the spout 18 and through a feed port 20 so that the end of the log is continuously held against the proximal cutting face of the disc 11.

The rotary disc 11 includes a predetermined number of radial cutting stations 21, each of the stations having an elongated knife assembly 22 situated adjacent a chip slot 23 that passes axially through the disc 11.

Figure 7:
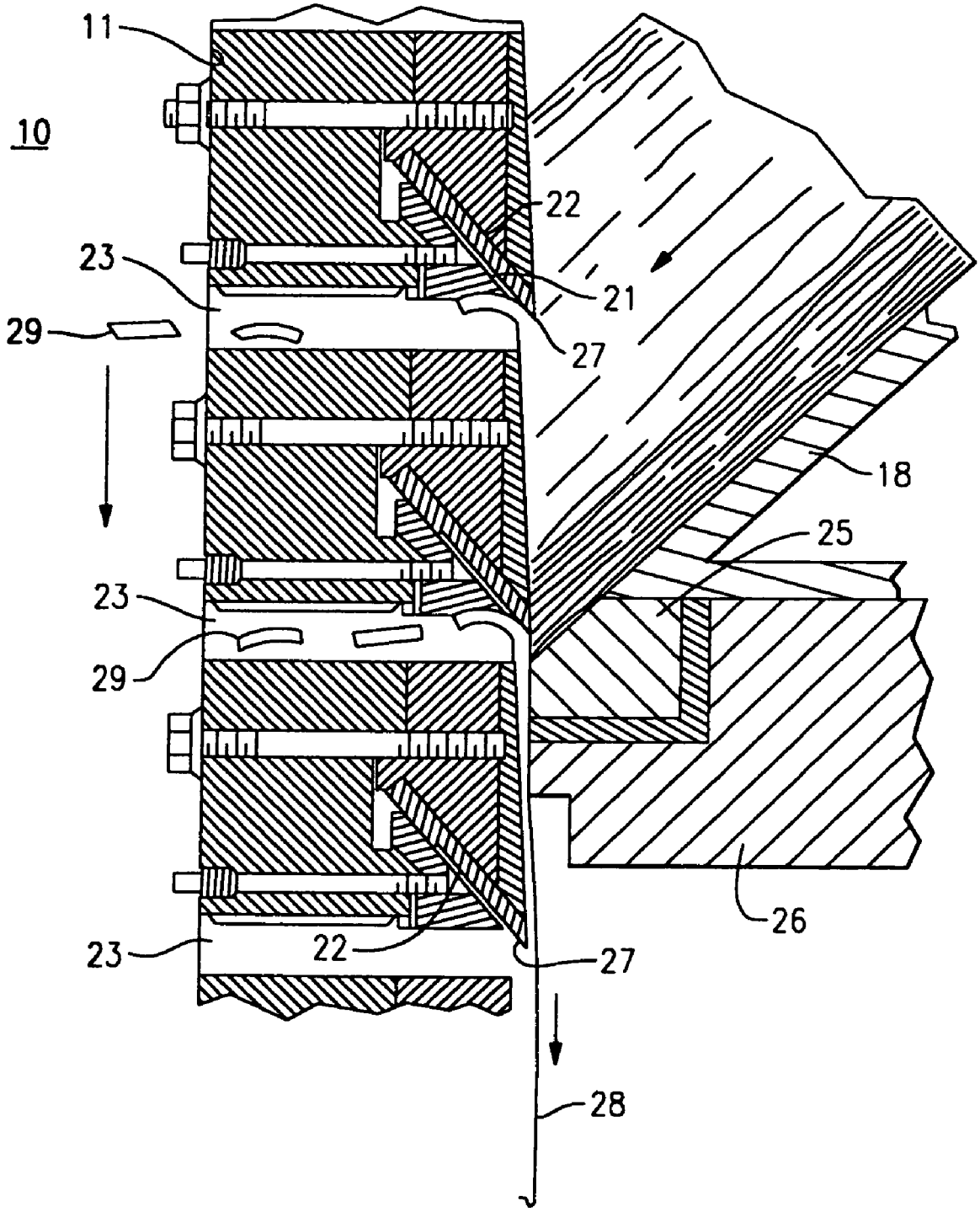
FIG.7 Prior Art
FIG. 7 is a partial side elevational view of a conventional chipper apparatus taken through the rotary disc of the apparatus, detailing the cutting action and formation of slivers.

Referring briefly to FIG. 7, a stationary bedknife 25 is positioned at the trailing edge of the feed port 20 and is supported in a front frame 26 of the chipper 10. The bedknife 25 includes a distal edge that is spaced by a small clearance (e.g., 0.015-0.060 inches), for example, from a predetermined plane at which the cutting edges of the knife assemblies 22 are disposed.

Referring to FIGS. 1 and 7, in operation and when the rotary disc 11 rotates across the feed port 20 of the spout 18 from a leading edge to a trailing edge thereof, the cutting knife assemblies 22 move past the stationary bedknife 25 at a high rate of speed. Chips 28 are rapidly cut from the face of the log 19. These chips 28 are directed into the associated chip slots 23, with the chips being passed out the distal or discharge side of the rotary disc 11, where they are exhausted into a discharge chute (not shown) and pass from the chipper 10.

Referring more specifically to FIG. 7, because the entering log 19 can be somewhat flexible as it passes through the spout 18, especially if the log is green, a long fillet or sliver 28 is ripped from the part of the log where the knife assemblies 22 are tangent to the log, i.e., where the blades leave the log 19. The incidence of slivers 28 increases when a considerable gap develops between the bedknife 25 and the knife edges 27. The slivers 28 can extend the entire length of the log 19, i.e., 25 to 50 feet. Often, these slivers 28 will become balled-up and can clog the machinery or size screening equipment downstream of the chipper 10. As the knives wear, the clearance or gap opens between the knife edges 27 and the bedknife 25, thereby increasing the sliver problem.

Normally, slivers 28 will proceed along a line that is parallel to the spout's projection onto the disc's face; i.e., in the direction normal to tangency where the knives leave the log. Because the wood is often very flexible and resilient, and because the wood grain extends lengthwise through sliver 28, the knife assemblies 22 do not cut through the sliver. The use of a peripheral sliver ring 24, also as shown in FIG. 1, assists in stopping the progress of slivers 28. This sliver ring 24, however, is provided at the outer periphery of the rotary disc 11 and therefore only acts to prevent slivers 28 from growing beyond a predetermined size. In addition, and when the cutting knives or the bedknife 25 becomes worn, the slivers 28 can be too large for the sliver ring 24 to be effective.

Figure 2:
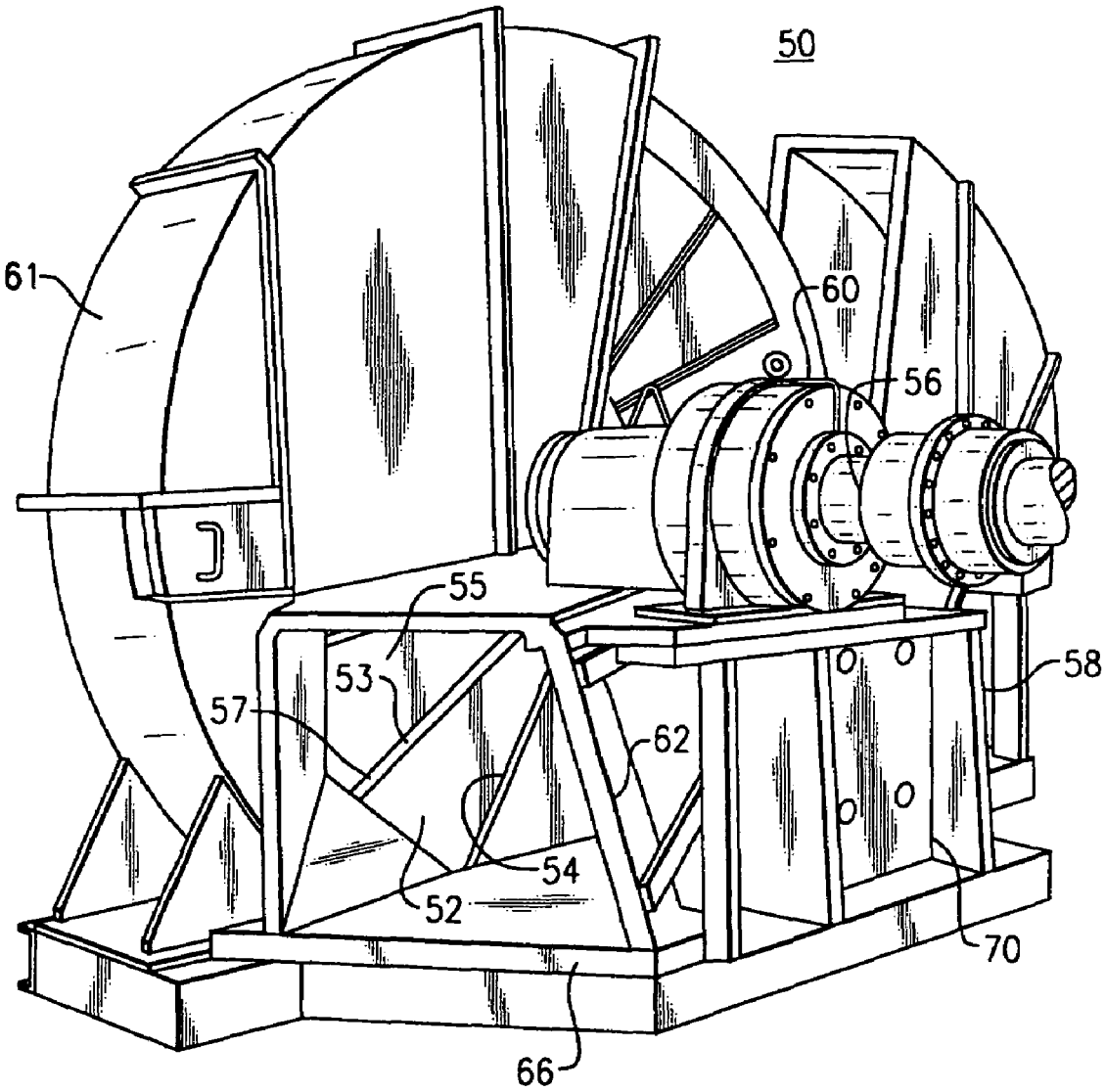
FIG. 2 is a perspective view of a disc chipper apparatus made in accordance with an exemplary embodiment.

With the preceding provided as background material, FIG. 2 illustrates a disc chipper 50 that is made in accordance with a preferred embodiment. The disc chipper 50 is somewhat similar to the foregoing in that this chipper includes a rotary disc 52 having a plurality of cutting stations 53, each of the cutting stations including a knife assembly 54, shown in FIG. 6, extending from a proximal facing surface 55 of the disc. Like the preceding, the disc 52 is rotated about a drive shaft 56 that is supported on a mount 58 in heavy-duty bearings 60, the disc further including a plurality of spaced chip slots 57, also as in the preceding, at each cutting station 53, passing axially through the disc. A motor (not shown) rotates the disc 52, the disc being shielded by a cover 61, such as in the manner previously described.

In addition and also like the preceding, a feed chute or spout 62 is disposed beneath the horizontal drive shaft 56. The feed spout 62 is mounted in relation to a chipper frame 70 beneath the drive shaft 56 of the disc 52 and logs (not shown in this view) are horizontally introduced into the spout by means of a conveyor (not shown) through a feed port 66 for chipping.

A bedknife 80 in accordance with an exemplary aspect of the invention is mounted in stationary relation at the feed port 66, the latter being disposed at a distal end of the feed spout 62. The bedknife 80 is mounted within the chipper frame 70 such that a substantially vertical primary cutting edge 84 is disposed in relation to the plane through which the edges of the knife assemblies 54, FIG. 6, pass as the disc 52 is rotated.

Figure 3:
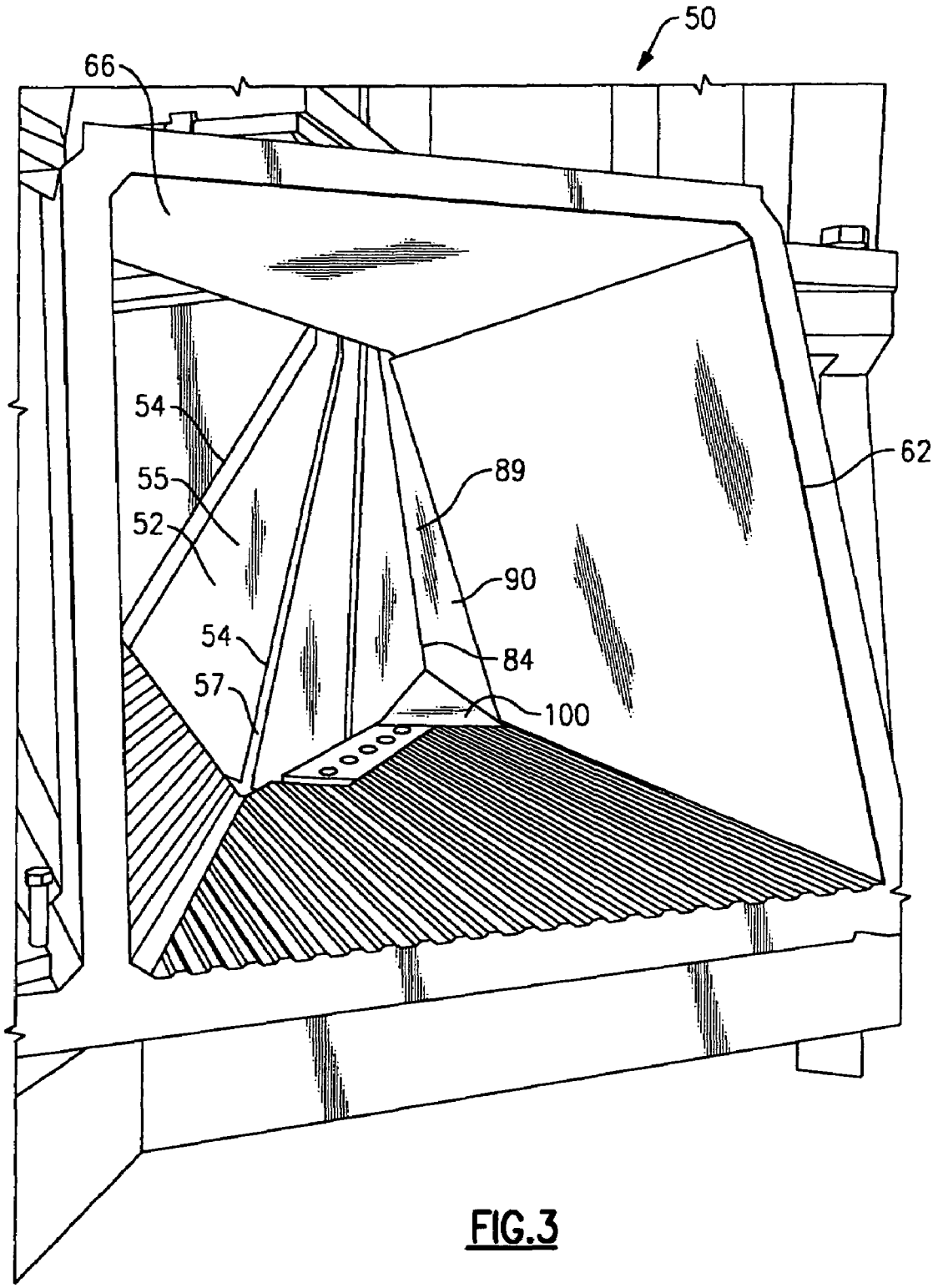
FIG. 3 is an enlarged view of the feed spout of the disc chipper apparatus of FIG. 2, including a bedknife made in accordance with a preferred embodiment.
Figure 4:
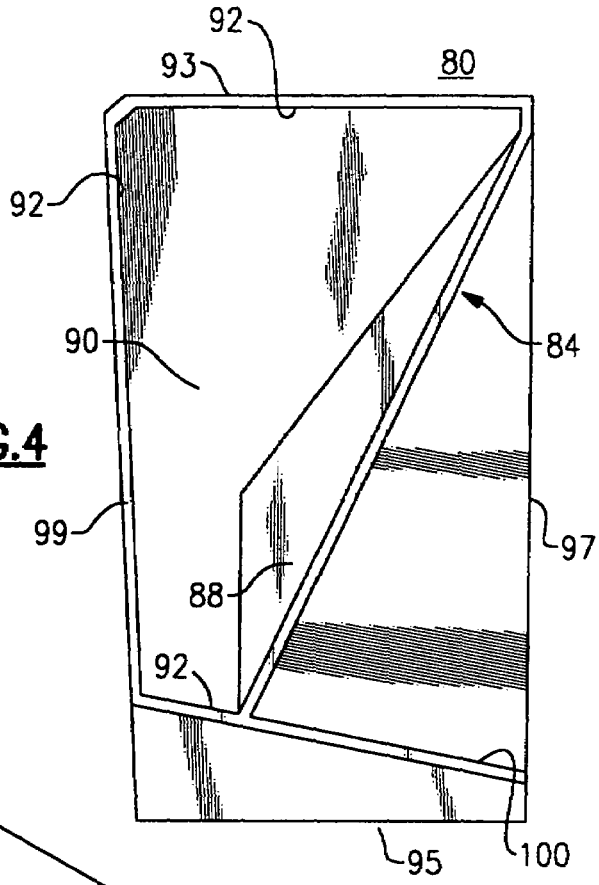
FIG. 4 is a disc side view of the bedknife partially shown in FIG. 3.
Figure 5:
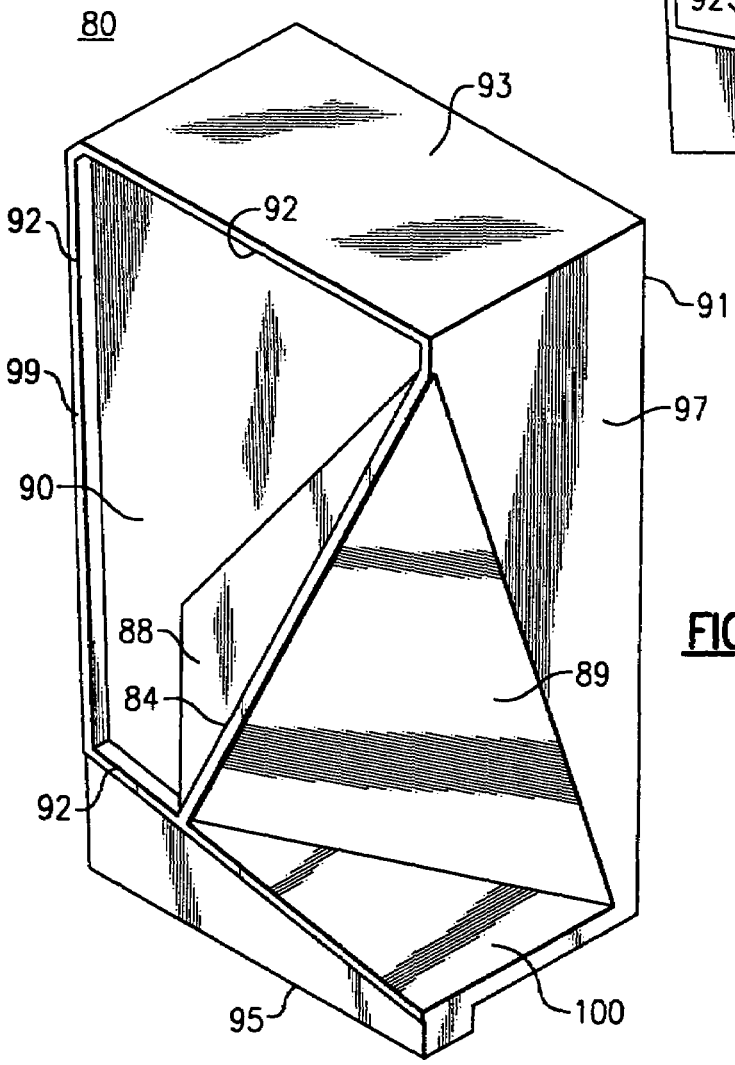
FIG. 5 is a disc side perspective view of the bedknife of FIGS. 3 and 4.
Figure 6:
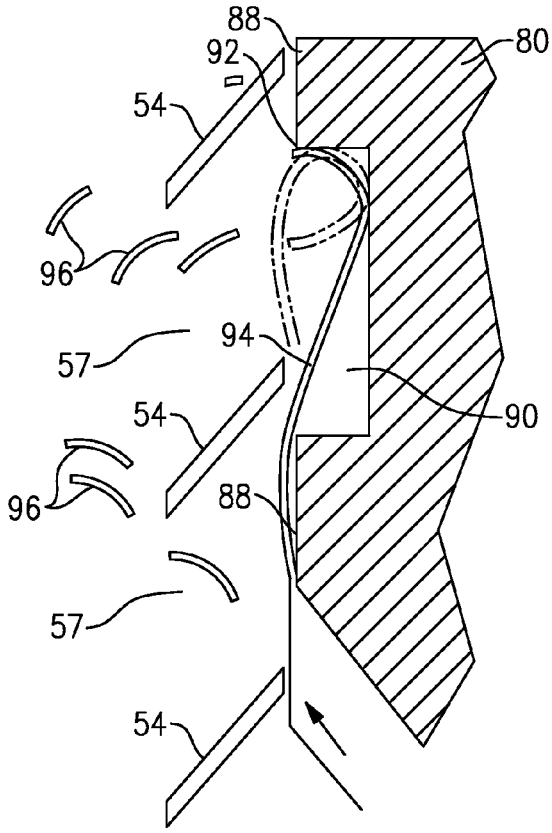
FIG. 6 is a partial side elevational view of the disc chipper apparatus, herein depicting the cutting action of the bedknife of FIGS. 3-5, including an integral sliver trimmer feature thereof.

Referring to FIGS. 4-6, the stationary bedknife 80 is defined by a unitary member made from steel or other suitable material. The bedknife 80 includes a plurality of surfaces defining a substantially cubic configuration, namely a front surface 88, a rear surface 91, a top surface 93, a bottom surface 95 and a pair of lateral surfaces 97, 99. The rear and top surfaces 91, 93 are substantially planar, wherein an angled surface 89 is formed between the lateral surface 97 and the front surface 88, this angled surface forming the primary cutting edge 84 of the bedknife at a distal edge thereof. The surface 89 extends angularly inward from the lateral surface 97 toward the front surface 88 and also forms a substantially horizontal base surface 100, the latter surface being aligned within the feed spout 62, FIG. 3, such that when mounted the front surface 88 of the bedknife 80 is parallel with the rotary disc 52. The horizontal base surface 100 is also angled in relation to the bottom surface 95 of the bedknife 80, wherein a small wedge is formed extending along the lower portion of the front surface 88 between the two lateral surfaces 97, 99.

Referring to FIGS. 4-6, a portion of the front surface 88 of the bedknife 80 is machined to create a recessed area 90 and to create a peripheral secondary cutting edge 92 extending along the edge of lateral surface 99, top surface 93 and also along a portion of the horizontal base surface 100 that acts to trim slivers that are produced by the cutting action. The functionality of the peripheral secondary cutting edge 92 and recessed area 90 is represented in FIG. 6 wherein a sliver, represented herein as 94, is passed into the recessed area 90 of the bedknife 80. The sliver 94 advances over the front surface 88 and is either drawn into the recessed area 90 where the sliver buckles (as shown in solid representation) and is trimmed or cut at the peripheral cutting edge 92 adjacent the lateral surface 99 or the top surface 93. Alternatively, the sliver 94 passes the front surface 88 and is drawn into the recessed area 90 where the sliver is curled upon itself (shown in phantom), the sliver then being cut into chips 96 at the plane of the cutting disc knives 54.

According to the present embodiment, the recessed area 90 is defined by a substantially constant depth of at least 0.250" and a width having a minimum dimension of at least 3 inches. According to the present embodiment, the width of the recessed area 90 is varied between the horizontal base surface 100 and top surface 93 in order to enhance the trapping of slivers 94, though this parameter can also be substantially constant. As noted, the recessed area 90 forms a peripheral second cutting edge 92, as well as a pocket or gap for the slivers 94 that are formed from the cutting operation. The edges forming the peripheral cutting edge 92 are cut at the same time as those of the primary cutting edge 84; therefore, adjustments in the bedknife 80 are not required.

Referring to FIGS. 3 and 4 and according to this embodiment, one of the pair of lateral surfaces 99 is angled in non-parallel relation to the opposing lateral surface 97. In this embodiment, lateral surface 99 is angled inwardly between the top surface 93 and the bottom surface 95 in order to create a taper. This taper extends in a direction which is substantially perpendicular to the rotary disc 52 (i.e., perpendicular to the axis of rotation of the disc) and therefore does not affect the clearance between the cutting plane and the primary cutting edge 84 of the bedknife 80. According to this embodiment, the angle $\alpha$ (FIG. 8) of the taper is approximately 3 degrees, though a range of 0.5-25 degrees is acceptable. As such, the bottom surface 95 has a smaller width than the top surface 93 and as a consequence the bedknife structure defines a truncate wedge.

Figure 8:
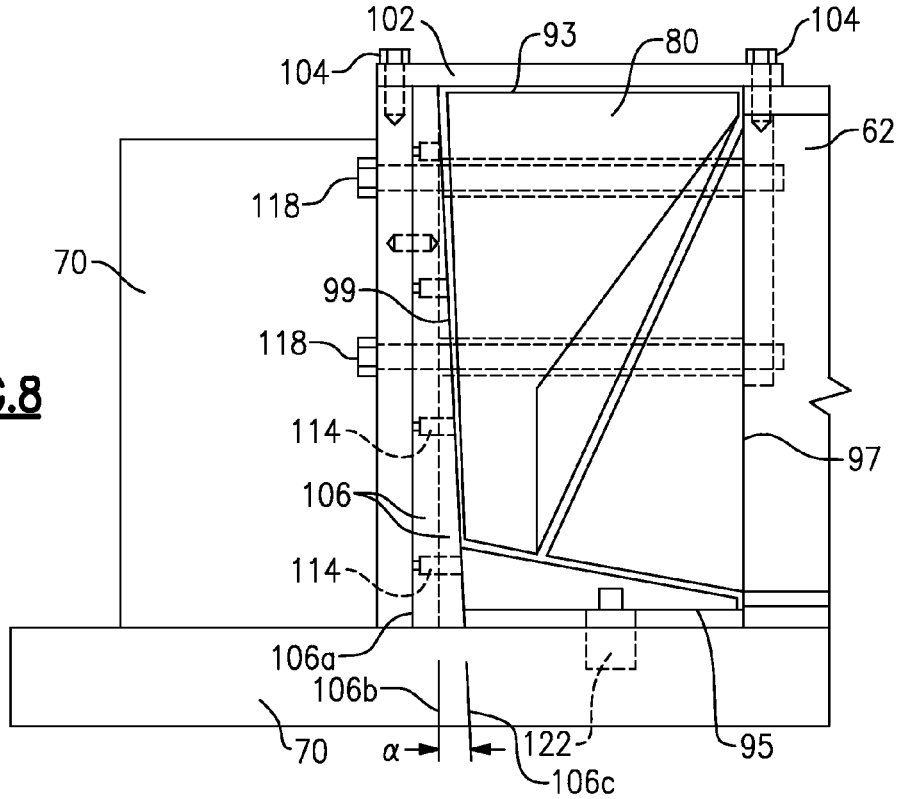
FIG. 8 illustrates the bedknife of FIGS. 3-5, as fitted within the chipper apparatus of FIGS. 2 and 3.

Referring to FIG. 8, the herein described taper of the lateral surface 99 permits the bedknife 80 to be positioned within the frame 70 of the chipper 50 in a pinched condition, the frame including a nonparallel gap into which the bedknife 80 can be introduced and removed. A cap 102 is attached in overlaying relation to the top surface 93 of the bedknife 80, the cap being a plate-like member that is sized to cover the top surface of the bedknife wherein bolts are used to mount the cap to the frame 70 and the feed spout 62 of the chipper 50 through corresponding holes provided therein in order to cause the tapered edges of the bedknife 80 to pinch within a defined frame pocket. Bedknife liners (only one 106 being shown) are optionally used and if so are disposed in relation to each of the lateral surface 99 and rear surface 91 of the bedknife 80, these liners being attached to the frame 70 by fasteners 114. The frame 70 or the bedknife liner 106 includes an outwardly angled taper, substantially matching that of the lateral surface 99 in order to provide a pinched fit when the bedknife 80 is placed within the frame pocket. The bedknife 80, according to this specific embodiment, is attached to the chipper frame 70 and the spout 62 by means of a pair of transverse bolts 118 that extend through corresponding holes provided in the side bedknife liner 106, bedknife 80, and feed spout 62, respectively.

Removal of the bedknife 80 in accordance with this embodiment is herein described with reference to FIG. 8. First, a small removable hood portion (not shown) of the chipper cover (not shown) is removed, thereby exposing the top cap 102. The bolts 104 of the top cap 102 can then be loosened from the frame 70 and the feed spout 62 and the top cap can be removed from the top surface 93 of the bedknife 80, thereby exposing the top surface. Each of the pair of transverse bolts 118 can also be removed, as accessed from the exterior of the chipper frame 70. Once the bedknife 80 is seated, separate means are therefore required to unseat the bedknife 80 from the frame 70. Therefore and according to this embodiment, a hydraulic or similar type of mechanical jack 122 is provided in relation to the bottom surface 95 of the bedknife 80, the latter being employed to loosen the bedknife 80 wherein a crane or other lifting apparatus (not shown) can be employed in order to then remove the bedknife 80 vertically from the defined pocket of the chipper frame 70.

PARTS LIST FOR FIGS. 1-8

10 disc chipper
11 rotary cutting disc
12 horizontal drive shaft
13 mount
14 bearing
15 cover
16 fixed portion
17 removable hood
18 feed chute or spout
19 log
20 feed port
21 cutting stations
22 knife assemblies
23 chip slots
24 sliver ring

25 bedknife
26 front frame
27 knife edges
28 slivers
50 chipper
52 rotary disc
53 cutting stations
54 knife assemblies
55 proximal facing surface
56 horizontal drive shaft
57 chip slots
58 mount
60 bearing
61 cover
62 feed chute or spout
66 feed port
70 chipper frame
80 bedknife
84 primary cutting edge
88 front surface
89 angled surface
90 recessed area
91 rear surface
92 peripheral secondary cutting edge
93 top surface
94 slivers
95 bottom surface
96 chips
97 lateral surface
99 lateral surface
100 horizontal base surface
102 top cap
104 bolts
106 bedknife liner
114 fasteners
118 transverse bolts
122 jack Though the invention has been shown based on certain embodiments, it will be readily apparent that there are other variations or modifications that can be made within the inventive concepts described herein and as set forth by the following claims. For example, the bedknife used herein can be applied to various chipper apparatus in addition to those described herein.

We claim:

1. A disc cutting apparatus for removing chips from a wooden work piece, said apparatus comprising:

a chipper frame for rotatably supporting a cutting disc that contains a plurality of radially disposed knife assemblies in relation to the front face of said disc;

a feed spout mounted in said chipper frame for feeding wood work pieces into contact with the front face of said cutting disc, said feed spout having a distal end located in close proximity with said front face of said cutting disc;

a bedknife having a first surface and an opposed second surface that is nonparallel to said first surface, a planar top surface and a planar bottom surface such that said bedknife establishes a truncated wedge shaped structure that tapers downwardly and inwardly from said top surface towards said bottom surface; and a gap formed in said chipper frame at the distal end of said feed spout that compliments the truncated wedge shape of said bedknife, said gap having a pair of opposed nonparallel side walls that engage the first and second opposed surfaces of the bedknife in supporting contact therewith.

2. A disc chipper apparatus as recited in claim 1, wherein said first and second surfaces are each lateral surfaces of said bedknife.

3. A disc chipper apparatus as recited in claim 2, wherein said bedknife is supported in said chipper frame such that said wedge extends in a direction that is substantially perpendicular to the axis of rotation of said cuffing disc.

4. A disc chipper apparatus as recited in claim 2, including a jack mounted in said frame in relation to said bottom surface of said bedknife for releasing said bedknife from said chipper frame.

5. A disc chipper apparatus as recited in claim 2, including a cap placed in overlaying relation to said top surface of said bedknife for said bedknife into engagement within said gap.

6. A disc chipper apparatus as recited in claim 1, including at least one bedknife liner, said at least one bedknife liner including a pair of opposed nonparallel surfaces defining a taper matching that of said bedknife wherein said at least one bedknife liner is introduced between a tapered surface of said bedknife and said gap.

7. A disc chipper apparatus as recited in claim 1, wherein said bedknife includes a vertical primary cutting edge located in one end wall of said wedge.

8. A disc chipper apparatus as recited in claim 1, wherein said gap is defined on one side by an interior surface of said feed spout.

* * * * *